US005698933A

United States Patent [19]

Smith

[11] Patent Number: 5,698,933

[45] Date of Patent: Dec. 16, 1997

[54] FIELD EMISSION DEVICE CURRENT CONTROL APPARATUS AND METHOD

[75] Inventor: Robert T. Smith, Mesa, Ariz.

[73] Assignee: Motorola, Inc., Schaumburg, Ill.

[21] Appl. No.: 656,727

[22] Filed: Jun. 3, 1996

Related U.S. Application Data

[63] Continuation of Ser. No. 279,380, Jul. 25, 1994, abandoned.

[51] Int. Cl.[6] ..... H01J 1/02

[52] U.S. Cl. ..... 313/309; 313/336; 313/351

[58] Field of Search ..... 313/309, 336, 313/351, 495; 445/24, 50, 51; 315/169.3, 169.1, 344, 349, 350, 351, 56, 58, 71

[56] References Cited

U.S. PATENT DOCUMENTS

| | | | |
|---|---|---|---|
| 4,008,412 | 2/1977 | Yuito et al. | 313/309 |
| 4,940,916 | 7/1990 | Borel et al. | 313/309 |
| 5,142,184 | 8/1992 | Kane . | |
| 5,173,634 | 12/1992 | Kane | 313/336 |
| 5,283,500 | 2/1994 | Kochanski | 313/309 |
| 5,285,129 | 2/1994 | Takeda et al. | 313/309 |
| 5,319,279 | 6/1994 | Watanabe et al. | 313/309 |
| 5,489,933 | 2/1996 | Betsui et al. | 315/169.1 |

*Primary Examiner*—Gerard R. Strecker
*Assistant Examiner*—Vip Patel
*Attorney, Agent, or Firm*—Eugene A. Parsons

[57] ABSTRACT

A field emission device (10) utilizes a resistive layer (13) between an extraction grid (14) and a conductive layer (12) to form a resistor (23). The resistor controls the amount of current flowing through an emission tip (16) of the field emission device (10).

10 Claims, 3 Drawing Sheets

FIELD EMISSION DEVICE CURRENT CONTROL APPARATUS AND METHOD

This application is a continuation of prior application Ser. No. 08/279,380, filed Jul. 25, 1994, now abandoned.

BACKGROUND OF THE INVENTION

The present invention relates, in general, to cold-cathode field emission devices, and more particularly, to a cold-cathode field emission device employing a novel current control protection scheme.

Field emission devices (FEDs) are well known in the art and are commonly employed for a broad range of applications including image display devices. An example of a FED is described in U.S. Pat. No. 5,142,184 issued to Robert C. Kane on Aug. 25, 1992. Prior FEDs typically have an emitter or emission tip that is utilized to emit electrons that are attracted to a distally disposed anode. A ballast resistor generally is connected in series with the tip to limit current flow through the tip in order to prevent damaging the tip. Typically, the ballast resistor is a doped area within a semiconductor substrate. Conductors are applied to connect the doped area as a series resistor between the emitter and an external voltage source. These ballast resistors require additional processing steps to form the doped area and additional processing steps to form the connections. The additional processing steps increase the cost of prior FEDs.

Accordingly, it is desirable to have a field emission device having a current control scheme that does not require forming doped areas within a semiconductor substrate in order to create a resistor, and that does not require additional metal layers to form connections to the resistor.

DETAILED DESCRIPTION OF THE DRAWINGS

Figure 1:
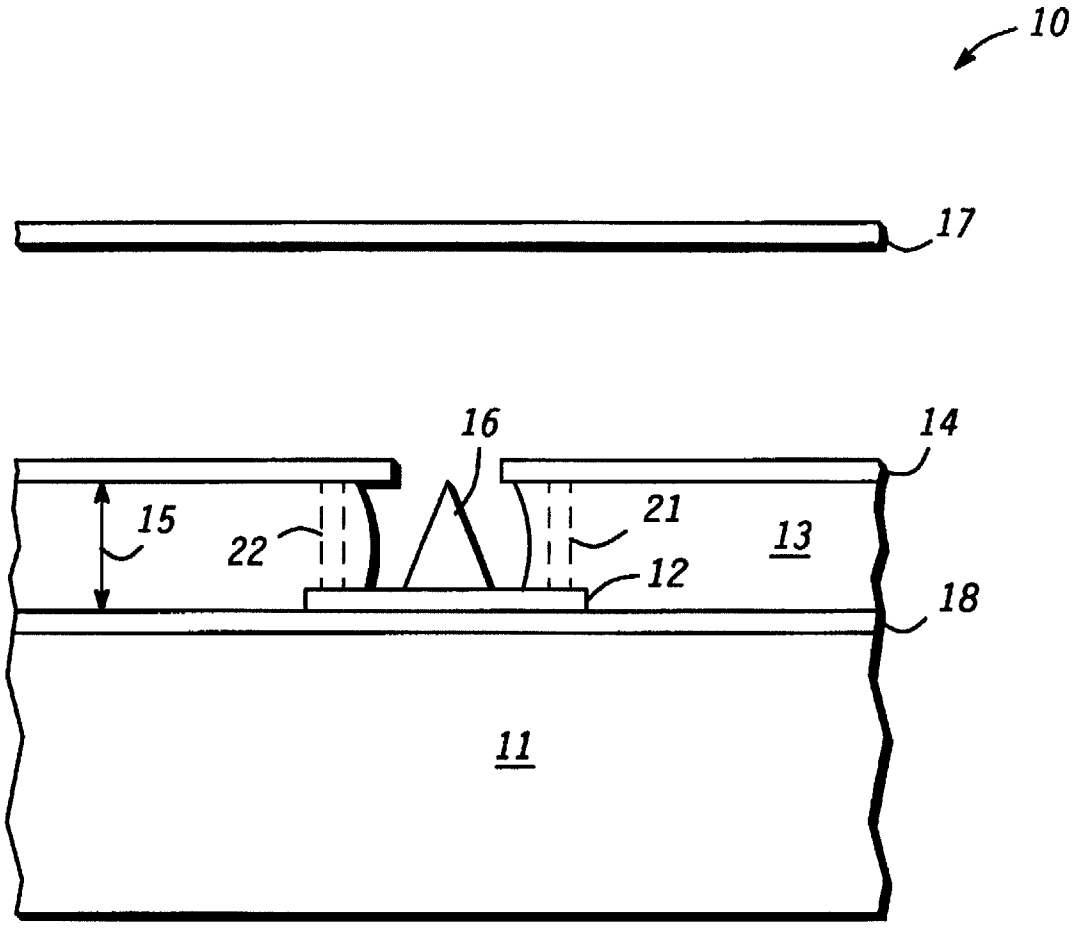
FIG. 1 illustrates an enlarged cross-sectional portion of a field emission device in accordance with the present invention.

FIG. 1 illustrates an enlarged cross-sectional portion of a field emission device (FED) 10 that includes a novel current limiting mechanism. Device 10 includes a substrate 11 on which other elements of device 10 are formed. The material used for substrate 11 can be any of a variety of insulating or semi-insulating substrates that are well known to those skilled in the art. In the preferred embodiment, substrate 11 is silicon having a resistivity of at least approximately $1\times10^8$ ohm-cm. Additionally, the preferred embodiment has a thin silicon dioxide insulating layer 18 on substrate 11 to insulate other elements of device 10 from substrate 11. A column conductor 12 is formed on substrate 11 and is utilized to provide electrical contact to a cold-cathode emitter or emission tip 16 that is formed on conductor 12. Typically, conductor 12 is formed in a stripe in order to connect a plurality of emission tips together as a column. Such column interconnect schemes are well known to those skilled in the art. A resistive layer 13 is formed on substrate 11 and layer 12, and is covered by an extraction grid 14. Grid 14 is utilized to assist in emitting electrons from emission tip 16 as is well known to those skilled in the art. Device 10 also includes an anode 17 that is distally disposed from grid 14. Such anodes are well known to those skilled in the art. As will be seen hereinafter, device 10 generally is formed as an array that includes a plurality of emission tips connected into a plurality of columns, and a plurality of grids 14 connected into a plurality of rows.

Resistive layer 13 is formed to contact conductor 12 in order to provide a resistive electrical connection between layer 13 and tip 16. As will be seen hereinafter, the resistance of layer 13 functions as a resistor in series with tip 16 and controls the amount of current flowing through tip 16. Because extraction grid 14 is in contact with layer 13, resistive layer 13 provides a resistive path for current flow between grid 14 and tip 16. As will be seen hereinafter, this resistive path is utilized to control the amount of current flowing through tip 16. The material utilized for layer 13 has a resistivity suitable for forming a current limiting resistor between grid 14 and tip 16. This value of this resistor depends on a thickness 15 of layer 13, illustrated by an arrow, in addition to the resistivity of the material used for layer 13 and the area of conductor 12 that is covered by layer 13. In the preferred embodiment, a resistor value of approximately five to fifteen gigaohms is used between layer 14 and tip 16. The preferred embodiment of thickness 15 to obtain such a value is approximately one to two microns, and the area of layer 12 covered by layer 13 is approximately twenty to thirty square microns. The preferred embodiment of layer 13 has a resistivity of approximately $1\times10^6$ to $1\times10^9$ ohm-cm in order to obtain the desired resistance value. Typically, the resistivity is less than $1\times10^9$ ohm-cm.

Figure 2:
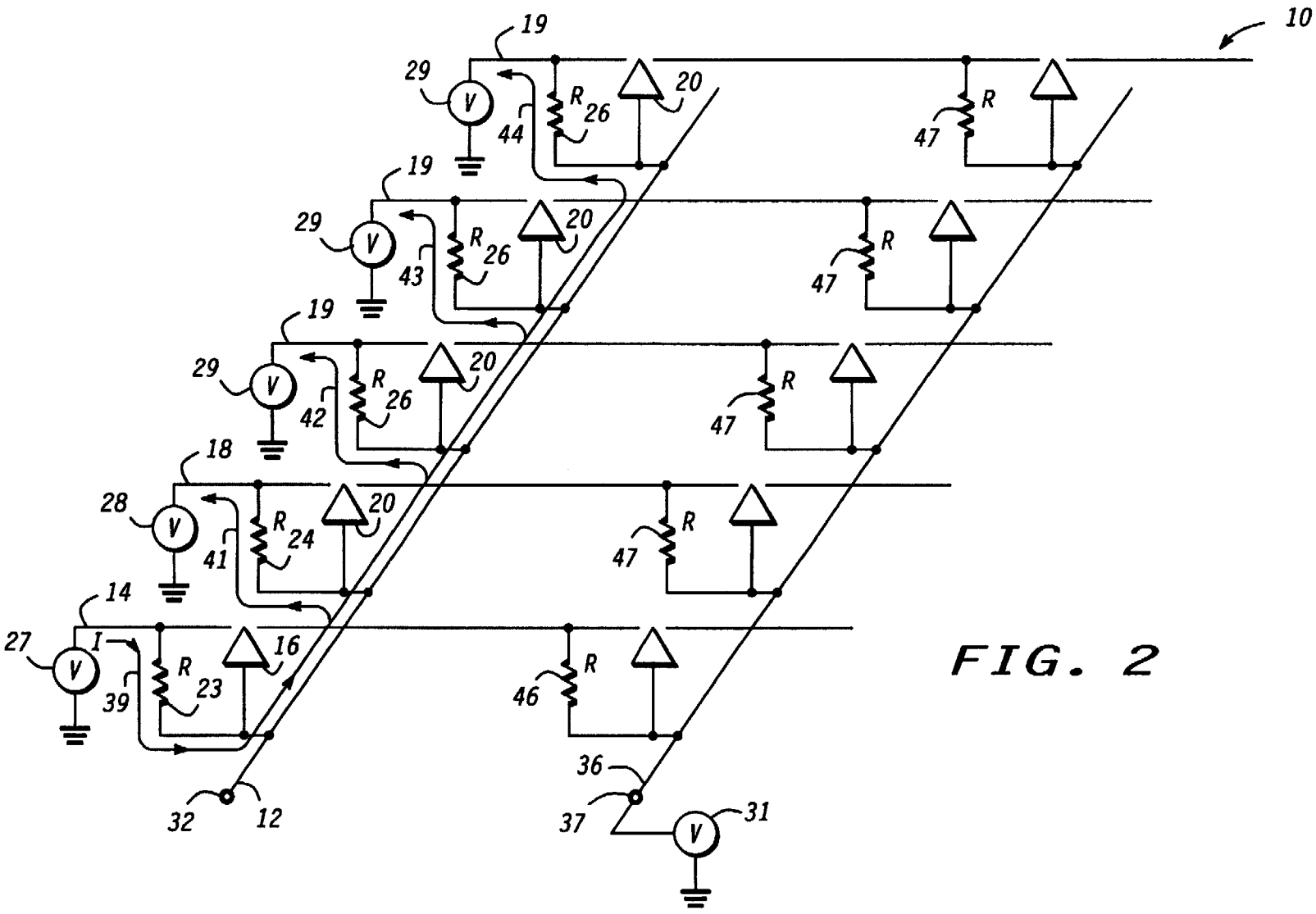
FIG. 2 schematically illustrates connections to a field emission device in accordance with the present invention.

FIG. 2 schematically illustrates a portion of the row and column configurations of FED 10 described in FIG. 1. Elements of the schematic shown in FIG. 2 that are the same as the structural elements of FIG. 1 have the same reference numbers. For ease of the explanation, FIG. 2 schematically illustrates other emission tips, grids, and column conductors of an array that are not illustrated in FIG. 1. Conductor 12 is utilized to connect tip 16 along with a plurality of emission tips 20 in a column configuration. Similarly a second conductor 36 connects other emission tips in a second column. Although only one additional column is shown for simplicity of the explanation, it is understood that device 10 can have many such column conductors. Conductor 36 has a terminal 37 for receiving a voltage from a voltage source 31 having a positive terminal connected to conductor 36 and a negative terminal connected to ground. Conductor 12 has a terminal 32 for receiving a voltage. As illustrated in FIG. 2, no voltage is applied to conductor 12 as will be explained hereinafter. Extraction grid 14 is utilized as a row conductor to address a particular row of emission tips, such as tip 16 and an emission tip that is connected to conductor 36. A second extraction grid 18, not shown in FIG. 1, is utilized as a second row conductor when addressing a first emission tip of the plurality of emission tips 20 and a second emission tip that is connected to conductor 36. Similarly, a plurality of extraction grids 19 are utilized as a plurality of row conductors when addressing other tips of the plurality of emission tips 20 and the emission tips connected to conductor 36.

A resistor 23 (designated by R) is used to schematically illustrate the resistance between grid 14 and tip 16 that is provided by resistance layer 13 (FIG. 1). Although shown as a lumped resistor, the resistance of resistor 23 is the equivalent resistance at each row and column intersection that results from the distributed resistance of layer 13. Resistor 23 effectively has a first end connected to grid 14 and a second end connected to tip 16. Similarly, a resistor 24 illustrates the resistance provided by resistance layer 13 (FIG. 1) between grid 18 and the first tip of the plurality of emission tips 20. A plurality of resistors 26 illustrate other equivalent resistors between the plurality of extraction grids 19 and other tips of the plurality of emission tips 20. Because resistors 23, 24, and 26 are formed by layer 13, resistors 23, 24, and 26 all have approximately equal values. In operation, a voltage source 27 has a positive terminal connected to extraction grid 14 and a negative terminal connected to ground in order to apply a first voltage to grid 14. Grid 18 is connected to a second voltage source 28 that has an output voltage that is smaller than the output voltage of source 27. Grids 19 are connected to a plurality of voltage sources 29 that have an output voltage value that is approximately equal to the output voltage of source 28. In the preferred embodiment, sources 28 and 29 connect grids 18 and 19 to ground. Voltage source 31 applies a third voltage to conductor 36. The third voltage is approximately equal to the output voltage of source 27 in order to ensure that the emission tips connected to conductor 36 are disabled.

Although a voltage source may be connected to conductor 12, the voltage source is disabled so that conductor 12 is floating. This condition is referred to as a floating cathode. As used herein, "floating cathode" means that a separate voltage source may be connected to conductor 12, but that this voltage source is disabled so that conductor 12 is allowed to float. Therefore, potentials derived from other voltage sources, such as voltage source 27, may be reflected on conductor 12 and on tip 16. Because of the floating cathode configuration, resistor 24 and resistors 26 form a plurality of parallel resistors that are in series with resistor 23, with each of the parallel resistors having a value approximately equal to the value of resistor 23. As a result, a portion of the output voltage of source 27 is applied to tip 16 and results in a voltage differential between tip 16 and grid 14. The voltage difference between tip 16 and grid 14 causes electrons to be emitted by tip 16. This can be seen by the path followed by a current 39, designated by the letter "I" and illustrated by an arrow, resulting from the output voltage of source 27. Current 39 flows through extraction grid 14 and through resistor 23 to conductor 12. Current 39 then splits and returns to ground through resistors 24 and 26, grids 18 and 19, and sources 28 and 29. Thus, the current flow through resistor 23 produces a differential voltage between tip 16 and grid 14 that results in electron emission from tip 16. It should be noted that because the output voltage of source 31 is approximately equal to the output voltage of source 27, current does not flow through a resistor 46, connected to conductor 36, to source 27. Current does flow from source 31 through resistors 47 to sources 28 and 29. However, this current produces a reverse voltage differential between the respective tips connected to conductor 36 and grids 18 and 19 so that there is no electrons emitted from the emitters connected to conductor 36 tip.

Figure 3:
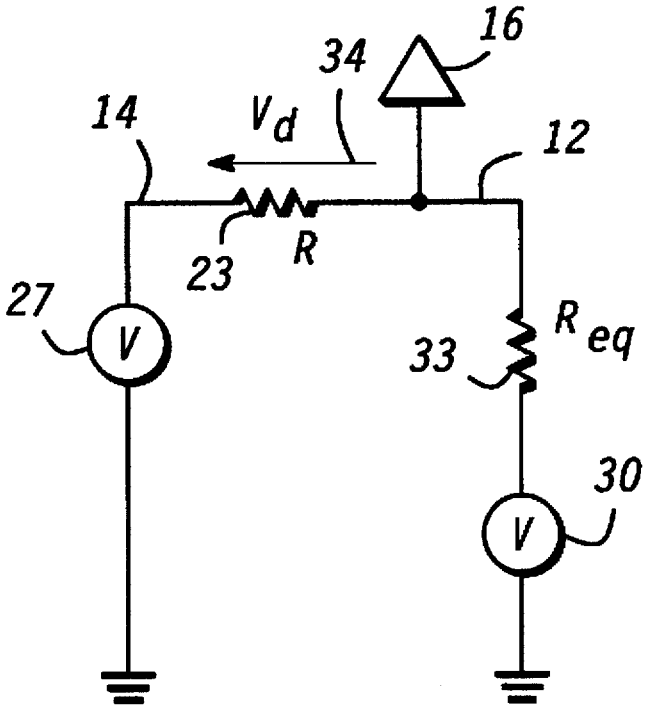
FIG. 3 illustrates an equivalent schematic of a field emission device shown in FIG. 1 and FIG. 2 in accordance with the present invention.

FIG. 3 schematically illustrates an equivalent circuit of some of the elements connected to tip 16 as shown in FIG. 2. Elements of FIG. 3 that are the same as FIG. 1 and FIG. 2 have the same reference numerals. The positive terminal of source 27 is connected to a first end of resistor 23 through extraction grid 14 as illustrated by the schematic in FIG. 3. The second end of resistor 23 is connected to tip 16 and to conductor 12. Conductor 12 connects tip 16 to an equivalent resistor 33, designated by "$R_{eq}$", that represents the equivalent resistance resulting from the parallel combination of resistor 24 and resistors 26 shown in FIG. 2. The value of $R_{eq}$ is R/(N−1) where R is the value of resistor 23 and N is the number of tips connected to conductor 12 (tips 16 and 20). Thus, the value of resistor 33 controls the amount of current flowing through tip 16. The second end of resistor 33 is connected to a voltage source 30 that represents voltage source 28 and plurality of voltage sources 29 shown in FIG. 2. As indicated hereinbefore, the preferred embodiment of voltage source 30 is a connection to ground.

A differential voltage 34, indicated by an arrow and designated by "$V_d$", between tip 16 and grid 14 produces electron emission from tip 16. The value of voltage 34 is given by the following equations:

$$V_d = V_g \frac{R}{R + R_{eq}}$$

$$V_d = V_g \frac{R}{R + \frac{R}{N-1}}$$

$$V_d = V_g \frac{N-1}{N}$$

where:

$V_g$=the output voltage of source 27,

R=the equivalent resistance of resistor 23 as explained in the description of FIG. 1 and FIG. 2, $R_{eq}$=R/(N−1) which is the equivalent parallel resistance of equivalent resistors connected to conductor 12 excluding the resistor connected to tip 16 (as shown in FIG. 2, resistors 24 and 26), and N=the total number of equivalent resistors (R) connected to conductor 12 (as shown in FIG. 2, resistors 23, 24, and 26).

As shown by FIG. 3, the current emitted by tip 16 is controlled by differential voltage 34 as defined by the voltage divider formed by resistors 23 and 33. Typically, N is a large number so that voltage 34 is approximately equal to voltage 27, thus, almost the entire voltage 27 is applied between tip 16 and grid 14. In the preferred embodiment, N is greater than approximately 100.

By utilizing a resistive layer between grid 14 and conductor 12, it is not necessary to employ extra processing steps to form doped areas to create resistors thereby reducing the cost of FED 10. Additionally connections to the resistor are provided by existing elements of the field emission device, thus, extra processing steps are not required to form connections to the resistor thereby further reducing the costs of FED 10.

Referring back to FIG. 1, an alternate embodiment of FED 10 utilizes a first resistor plug 21 and a second resistor plug 22 through layer 13 to form resistors 23, 24, and 26. Plugs 21 and 22 can be formed by etching an opening through layer 13, and then filling layer 13 with a resistive material that provides the desired resistance value. In such a configuration, layer 13 can be a dielectric since the desired resistance is provided by plugs 21 and 22. Also a single plug may be sufficient to provide the desired resistance value. In the preferred embodiment, layer 13 is silicon dioxide and plugs 21 and 22 are titanium oxide.

By now it should be appreciated that there has been provided a field emission device current control apparatus. By utilizing a resistive layer to function as a plurality of resistors, current limiting resistors can be formed. Consequently, additional processing steps required to implement individual ballast resistors for each emission tip are not required thereby saving process time and cost and resulting in a lower cost field emission device.

I claim:

1. A field emission device current control apparatus comprising:

a plurality of columns of emission tips on a substrate including a first column of emission tips and a second column of emission tips, with all of the emission tips in the first column electrically connected together and all of the emission tips in the second column electrically connected together, one extraction grid being associated with each emission tip;

a plurality of rows of extraction grids including a first row of extraction grids and a second row of extraction grids, with all of the extraction grids in the first row connected together and all of the extraction grids in the second row connected together;

a first voltage applied to the first row of extraction grids;

a second voltage coupled to the second row of extraction grids, the second voltage being smaller than the first voltage;

a third voltage that is approximately equal to the first voltage, the third voltage applied to the second column of emission tips; and a resistive layer coupled between the first column of emission tips and the first row of extraction grids and coupled between the second column of emission tips and the second row of extraction grids wherein the resistive layer has a resistivity no greater than $1\times10^9$ ohm-cm to produce a resistive value of approximately 5 to 15 gigaohms between each extraction grid and an associated emission tip.

2. The device of claim 1 wherein the second voltage is a ground potential.

3. The device of claim 1 wherein the first column of emission tips is coupled as a floating cathode.

4. A field emission device current control apparatus comprising:

a plurality of columns of emission tips on a substrate including a first column of emission tips and a second column of emission tips, with all of the emission tips in the first column electrically connected together and all of the emission tips in the second column electrically connected together;

a plurality of rows of extraction grids including a first row of extraction grids and a second row of extraction grids, with all of the extraction grids in the first row connected together and all of the extraction grids in the second row connected together;

a first voltage applied to the first row of extraction grids;

a second voltage coupled to the second row of extraction grids, the second voltage being smaller than the first voltage;

a third voltage that is approximately equal to the first voltage, the third voltage applied to the second column of emission tips; and a resistive layer coupled between the first column of emission tips and the first row of extraction grids and coupled between the second column of emission tips and the second row of extraction grids wherein the resistive layer has a resistivity no greater than $1\times10^9$ ohm-cm and wherein the resistive layer includes a dielectric layer having a resistive plug through the dielectric layer to provide the resistivity.

5. A field emission device comprising:

an emission tip on a substrate;

a plurality of extraction grids; and a resistive layer coupled between the emission tip and the plurality of extraction grids wherein the resistive layer has a resistivity no greater than approximately $1\times10^9$ ohm-cm and includes a resistive plug in a dielectric layer to provide the resistivity.

6. A method of forming a field emission device comprising:

providing a supporting substrate;

positioning conductive columns on the substrate;

positioning a resistive layer on the substrate partially overlying the conductive columns, the resistive layer having a resistivity greater than $1\times10^9$ ohm-cm;

positioning a plurality of emission tips on the conductive columns;

positioning a plurality of rows of extraction grids on the resistive layer, one each adjacent each emission tip; and using the resistive layer as a resistor to control an amount of current flowing through each of the plurality of emission tips of the field emission device wherein the resistive layer is electrically coupled between each of the extraction grids and the adjacent emission tip so as to produce a resistive value of approximately 5 to 15 gigaohms between each extraction grid and the adjacent emission tip.

7. The method of claim 6 wherein using the resistive layer as the resistor includes the resistive layer having a resistivity not greater than approximately $1\times10^9$ ohm-cm.

8. The method of claim 6 further including having a first voltage coupled to the first row of extraction grids and a second voltage that is smaller than the first voltage coupled to the second row of extraction grids wherein the second extraction grid is on the resistive layer.

9. The method of claim 8 further including having the emission tip coupled as a floating cathode.

10. A method of forming a field emission device comprising:

providing a supporting substrate;

positioning conductive columns on the substrate;

positioning a resistive layer on the substrate partially overlying the conductive columns;

positioning a plurality of emission tips on the conductive columns;

positioning a plurality of rows of extraction grids on the resistive layer, one each adjacent each emission tip; and using the resistive layer as a resistor to control an amount of current flowing through each of the plurality of emission tips of the field emission device wherein the resistive layer is coupled between each of the extraction grids and the adjacent emission tip, the resistive layer including a resistive plug in a dielectric layer that is positioned between and electrically coupled to one of the extraction grids and a conductive column of the plurality of conductive columns on which the adjacent emission tip is positioned.

* * * * *